US006211838B1

(12) United States Patent
Cherrette et al.

(10) Patent No.: US 6,211,838 B1
(45) Date of Patent: Apr. 3, 2001

(54) HIGH EFFICIENCY DUAL POLARIZED HORN ANTENNA

(75) Inventors: Alan Cherrette, Los Altos; Rajan Parrikar, Mountain View; Terry Smith, La Honda, all of CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/497,036

(22) Filed: Feb. 2, 2000

(51) Int. Cl.[7] ..... H01Q 13/00
(52) U.S. Cl. ..... 343/786
(58) Field of Search ..... 343/772, 776, 343/786

(56) References Cited

U.S. PATENT DOCUMENTS

| | | | | |
|---|---|---|---|---|
| 3,883,877 | * | 5/1975 | Chabah et al. | 343/778 |
| 4,811,028 | * | 3/1989 | Bryanos | 343/786 |
| 5,754,144 | * | 5/1998 | McEwan | 343/786 |
| 5,883,604 | * | 3/1999 | Nicely | 343/786 |

* cited by examiner

*Primary Examiner*—Tan Ho
(74) *Attorney, Agent, or Firm*—Kenneth W. Float

(57) ABSTRACT

A dual polarized horn antenna that increases the efficiency of a square or rectangular aperture which may be used in situations where a high efficiency aperture is needed in a constrained space. The antenna has a body that is tapered from a first end to a second end, wherein the first end is smaller in cross section than the second end. A flange is formed around the periphery of the body adjacent to the first end. An opening is formed in the first end of the body. A tuning iris is preferably disposed in the opening that provides for impedance matching. An insert is disposed in the central tapered opening 16 adjacent to the second end that has a central cross-shaped tapered member. The central cross-shaped tapered member extends into the central tapered opening and forms a plurality waveguide passages that form a corresponding plurality of quadrants. A plurality of cross-shaped members are respectively disposed in the quadrants and extend a short distance into the central tapered opening. The antenna may be advantageously used where longer apertures are desired. The antenna has a radiating efficiency on the order of 97 percent.

7 Claims, 2 Drawing Sheets

HIGH EFFICIENCY DUAL POLARIZED HORN ANTENNA

BACKGROUND

The present invention relates generally to antennas, and more particularly, to an improved high efficiency dual polarized horn antenna.

The closest prior art relating to the present invention known to the inventors is an antenna developed by the assignee of the present invention. This antenna had its aperture divided into four sections. This division of the antenna aperture improved the illumination efficiency from 81 percent to 90 percent compared to antenna without a divided aperture. However, this prior art antenna was limited to a two wavelength aperture.

Accordingly, it would be advantageous to have a high efficiency dual polarized horn antenna whose performance is further improved over the above-described four-segment divided aperture antenna, and also can be applied to large horn apertures

SUMMARY OF THE INVENTION

The present invention provides for a high efficiency dual polarized horn antenna. The dual polarized horn antenna comprises a body that is tapered from a first end to a second end such that the first end is smaller in cross section that the second end. A flange is formed around the periphery of the body adjacent the first end, and an opening is formed in the first end of the body. A tuning iris is preferably disposed at the opening that provides for impedance matching. An insert is disposed in the central tapered opening adjacent to the second end of the body that comprises a central cross-shaped tapered member. The central cross-shaped tapered member extends into the central tapered opening and forms a plurality of waveguide passages through the horn antenna that form a corresponding plurality of quadrants. A plurality of cross-shaped members are respectively disposed in the quadrants and extend a short distance into the central tapered opening.

The present horn antenna increases the efficiency of a square or rectangular aperture which may be used in situations where a high efficiency aperture is needed in a constrained space. The antenna may be advantageously used where larger apertures are desired. The antenna has a radiating efficiency on the order of 97 percent compared to the 81 percent radiating efficiency of an undivided aperture antenna, or the 90% efficiency of the prior art four-segment divided aperture antenna. The present invention thus provides for a dual polarized horn antenna that has higher efficiency that prior antennas and is not limited to apertures of less than two wavelenghts.

BRIEF DESCRIPTION OF THE DRAWINGS

The various features and advantages of the present invention may be more readily understood with reference to the following detailed description taken in conjunction with the accompanying drawings wherein like reference numerals designate like structural elements, and in which.

DETAILED DESCRIPTION

Figure 1:
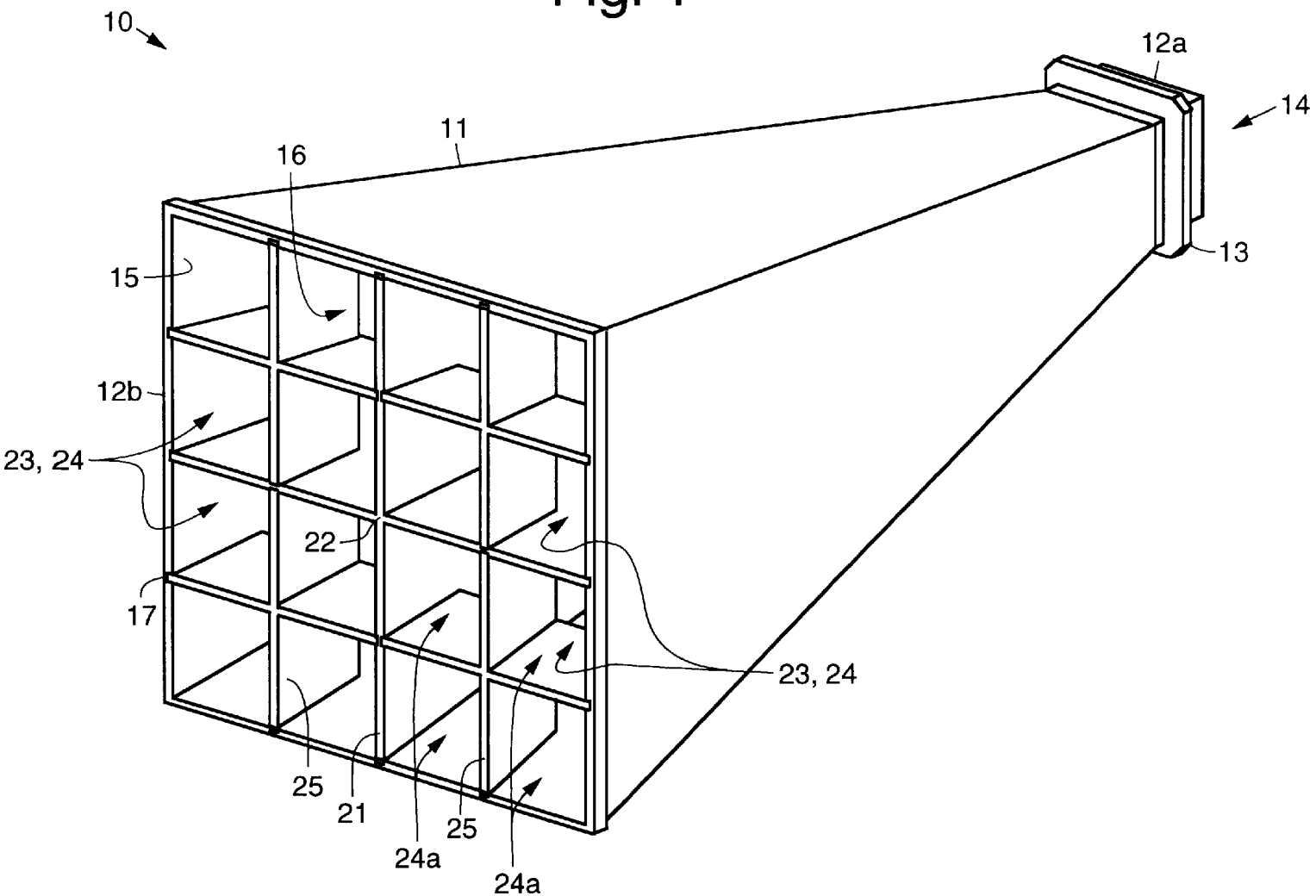
FIG. 1 illustrates an exemplary embodiment of a high efficiency dual polarized horn antenna in accordance with the principles of the present invention.
Figure 2:
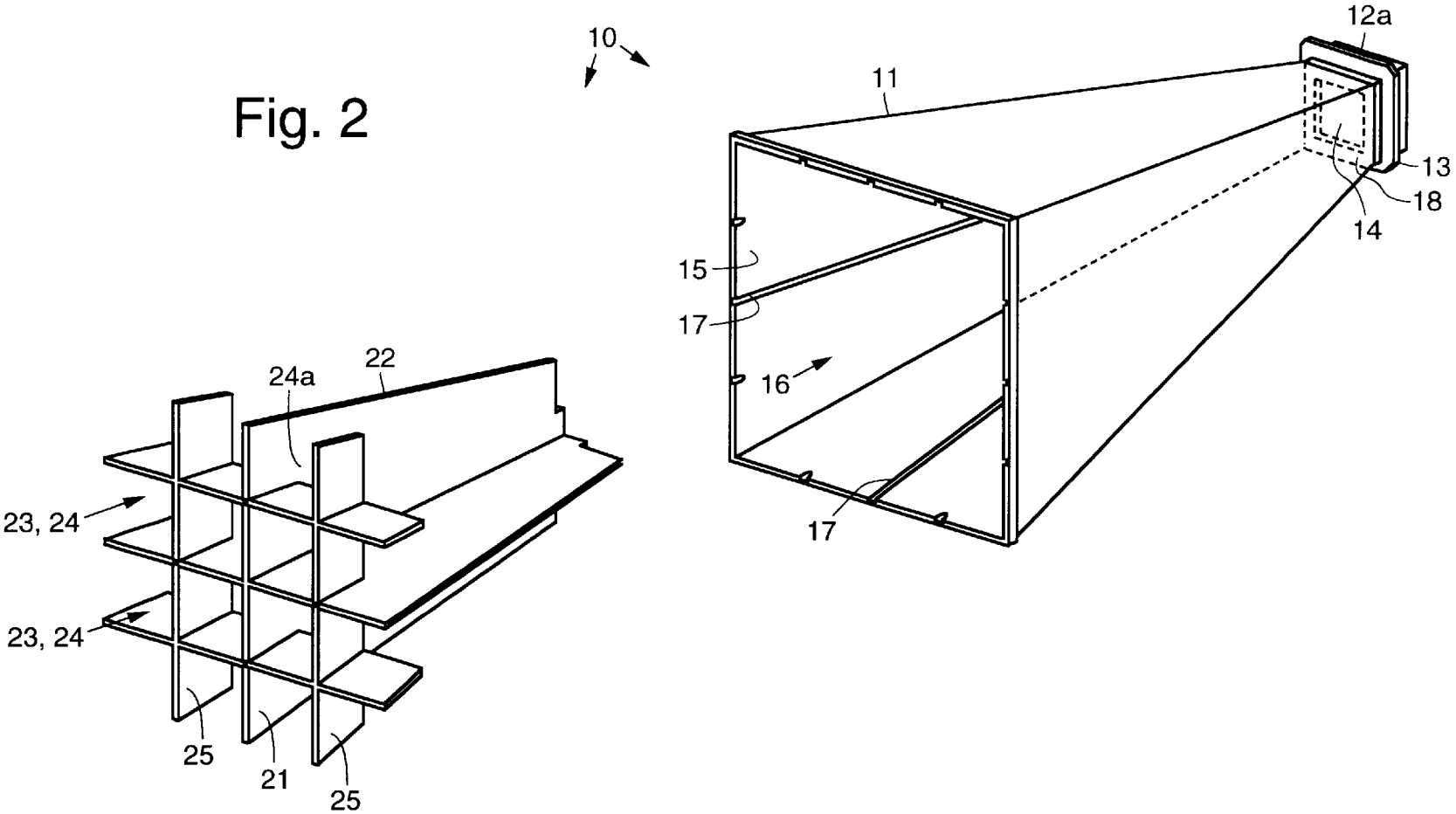
FIG. 2 illustrates an exploded view of the dual polarized horn antenna shown in FIG. 1.

Referring to the drawing figures, FIG. 1 illustrates exemplary embodiment of a high efficiency dual polarized horn antenna 10 in accordance with the principles of the present invention. FIG. 2 illustrates an exploded view of the dual polarized horn antenna 10 shown in FIG. 1.

The high efficiency dual polarized horn antenna 10 comprises a body 11, which may have square or rectangular in cross-section. The body 11 is tapered from a first end 12*a* to a second end 12*b*. The first end 12*a* of the body 11 is smaller in cross section that the second end 12*b*. A flange 13 is formed around the periphery of the body 11 adjacent to the first end 12*a*. An opening 14 is formed in the first end 12*a* of the body 11. A tuning iris 18 is preferably disposed at the opening 14 in the first end 112*a* of the body 11. The tuning iris 18 provides for impedance matching of the dual polarized horn antenna 10.

Inner side walls 15 of the body 11 define a central tapered opening 16 through the horn antenna 10. One or more slots 17 are longitudinally formed along the length of each of the inner side walls 15.

An insert 21 is disposed in the central tapered opening 16 adjacent to the second end 12*b* of the body 11. The insert 21 is inserted into the central tapered opening 16 from the second end 12*b* of the body 11. The insert 21 has a central cross-shaped tapered member 22 that extends into the central tapered opening 16. The central cross-shaped tapered member 22 forms four waveguide passages 23 through the horn antenna 10 that form four quadrant 24. The central cross-shaped tapered member 22 has a step-shaped configuration at an end thereof that is adjacent the first end 12*a* of the body 11.

At the second end 12*b* of the body 11, each quadrant 24 is subdivided into four subquadrants 24*a* by respective cross-shaped members 25. The cross-shaped members 25 extend a short distance into the central tapered opening 16. Thus, the exemplary embodiment of the horn antenna 10 has sixteen apertures 27 formed at the second end 12*a* of the body 11. However, depending upon the desired application for the horn antenna 10, it is to understood that each quadrant 24 may be subdivided into any number of sections or subquadrants 24*a* equal to $2^n$, where n is real and positive, by appropriately-sectioning the respective cross-shaped members 25.

The exemplary embodiment of the horn antenna 10 transforms the aperture 27 of a square or rectangular horn with its inherent 81 percent illumination efficiency into an aperture 27 with nearly uniform illumination. The efficiency of the antenna aperture 27 approaches 100 percent (97 percent) and therefore provides maximum antenna gain for this size of aperture 27.

Thus, an improved high efficiency dual polarized horn antenna has been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A dual polarized horn antenna comprising:

a body that is tapered from a first end to a second end and wherein the first end is smaller in cross section than the second end;

a flange formed around the periphery of the body adjacent the first end;

an opening formed in the first end of the body;

an insert disposed in a central tapered opening adjacent to the second end of the body that comprises a central cross-shaped tapered member that extends into the central tapered opening and forms a plurality waveguide passages through the horn antenna that form a corresponding plurality of quadrants; and a plurality of cross-shaped members respectively disposed in the quadrants that extend a short distance into the central tapered opening.

2. The antenna recited in claim 1 further comprising a tuning iris disposed at the opening in the first end of the body.

3. The antenna recited in claim 1 wherein the body has a square cross-section.

4. The antenna recited in claim 3 wherein the body has a rectangular cross-section.

5. The antenna recited in claim 1 wherein the body has inner side walls that define the central tapered opening, and wherein one or more slots are longitudinally formed along the length of each of the inner side walls.

6. The antenna recited in claim 1 wherein the central cross-shaped tapered member has a step-shaped configuration adjacent the first end of the body that mates with the opening in the first end of the body.

7. The antenna as recited in claim 1 wherein the plurality of cross-shaped members respectively disposed in the quadrants are subdivided into a predetermined number of sub-quadrants equal to $2^n$, where n is real and positive, by appropriately-sectioning the respective cross-shaped members.

* * * * *